US011565292B2

(12) United States Patent
Fontayne et al.

(10) Patent No.: US 11,565,292 B2
(45) Date of Patent: Jan. 31, 2023

(54) ROLL STAND AND METHOD FOR CHANGING WORK ROLLS

(71) Applicant: SMS GROUP GMBH, Düsseldorf (DE)

(72) Inventors: Dietmar Fontayne, Hilchenbach (DE); Stephan Fischer, Hilchenbach (DE)

(73) Assignee: SMS GROUP GMBH, Düsseldorf (DE)

( * ) Notice: Subject to any disclaimer, the term of this patent is extended or adjusted under 35 U.S.C. 154(b) by 354 days.

(21) Appl. No.: 15/762,656

(22) PCT Filed: Sep. 1, 2016

(86) PCT No.: PCT/EP2016/070622
§ 371 (c)(1),
(2) Date: Mar. 23, 2018

(87) PCT Pub. No.: WO2017/050535
PCT Pub. Date: Mar. 30, 2017

(65) Prior Publication Data

US 2018/0272398 A1 Sep. 27, 2018

(30) Foreign Application Priority Data

Sep. 24, 2015 (DE) ..... 10 2015 218 360.2

(51) Int. Cl.
*B21B 31/10* (2006.01)
*B21B 31/20* (2006.01)
*B21B 31/12* (2006.01)

(52) U.S. Cl.
CPC ..... *B21B 31/106* (2013.01); *B21B 31/203* (2013.01); *B21B 31/12* (2013.01)

(58) Field of Classification Search
CPC ..... B21B 31/106; B21B 31/08; B21B 31/10; B21B 31/02; B21B 31/20; B21B 31/206;
(Continued)

(56) References Cited

U.S. PATENT DOCUMENTS 3,695,080 A 10/1972 Sevenich et al.
3,736,785 A 6/1973 Marten
(Continued)

FOREIGN PATENT DOCUMENTS

CN 1463208 A 12/2003
CN 101733285 A 6/2010
(Continued)

OTHER PUBLICATIONS

English Translation of Chinese Office Action, Application No. 201680055859X, dated Jan. 4, 2019.
(Continued)

*Primary Examiner* — Debra M Sullivan
(74) *Attorney, Agent, or Firm* — Lucas & Mercanti, LLP; Klaus P. Stoffel

(57) ABSTRACT

A roll stand having work rolls mounted therein. The roll stand has at least one upper mounting rail, which is mounted on the drive-side roll stand frame and oriented in a transverse direction to a rolling line running through the roll stand. In order to be able to keep the assembly space in the roll stand over the rolling line free during rolling—except for a roll change—and still change the roll efficiently, the upper mounting rail is configured to be moved into the rolling line and out of the rolling line, starting from the drive-side roll stand frame.

15 Claims, 5 Drawing Sheets

(58) Field of Classification Search
CPC ..... B21B 31/203; B21B 31/12; B21B 31/103; B21B 31/22
See application file for complete search history.

(56) References Cited

U.S. PATENT DOCUMENTS

| | | | | |
|---|---|---|---|---|
| 3,754,426 | A | 8/1973 | Adair | |
| 3,864,954 | A | 2/1975 | Eibe et al. | |
| 3,946,587 | A * | 3/1976 | Maltby | B21B 13/005 72/237 |
| 4,944,175 | A * | 7/1990 | Svagr | B21B 13/10 72/225 |
| 5,031,435 | A * | 7/1991 | Seto | B21B 27/028 72/247 |
| 5,090,228 | A | 2/1992 | Schmiedberg | |
| 7,381,301 | B2 | 6/2008 | Wittkopf | |
| 2004/0144150 | A1* | 7/2004 | Le Viavant | B21B 31/10 72/239 |

FOREIGN PATENT DOCUMENTS

| | | | |
|---|---|---|---|
| DE | 1952646 | A1 | 7/1971 |
| DE | 2022385 | A1 | 12/1971 |
| DE | 2027350 | A1 | 12/1971 |
| DE | 2204971 | A1 | 8/1972 |
| DE | 2453857 | A1 | 6/1975 |
| DE | 3843387 | A1 | 7/1990 |
| DE | 10052855 | A1 | 5/2002 |
| DE | 10116988 | A1 | 10/2002 |
| DE | 10138589 | A1 | 2/2003 |
| GB | 1341982 | A | 12/1973 |
| GB | 2094684 | A | 9/1982 |
| JP | S59107711 | A | 6/1984 |
| JP | S609507 | A | 1/1985 |
| JP | S6160208 | A | 3/1986 |
| JP | H0220603 | A | 1/1990 |
| JP | H10128414 | A | 5/1998 |
| JP | 2000126807 | A | 5/2000 |
| JP | 2006075857 | A | 2/2006 |
| JP | 2006075857 | A | 3/2006 |
| JP | 2006075857 | A * | 3/2006 |
| JP | 2012232332 | A | 11/2012 |

OTHER PUBLICATIONS

Chinese Appl No. 201680055859X Office Action, dated Sep. 3, 2019, 2 Pages.

* cited by examiner

ROLL STAND AND METHOD FOR CHANGING WORK ROLLS

The present application is a 371 of International application PCT/EP2016/070622, filed Sep. 1, 2016, which claims priority of DE 10 2015 218 360.2, filed Sep. 24, 2015, the priority of these applications is hereby claimed and these applications are incorporated herein by reference.

BACKGROUND OF THE INVENTION

The invention pertains to a roll stand and to a method for changing work rolls supported in the roll stand. The roll stand can be provided for use in cold-rolling or hot-rolling mills. The roll stand can be, for example, a Mae-West stand. The stock to be rolled is preferably a metal section or a metal strip Roll stands of the class in question which make it possible to change the rolls are already known from the prior art. Reference is made to DE 101 16 988 A1, which shows such a solution. Similar and other solutions are shown in GB 2 094 684 A and JP H02 20603 A. However, these often have a quite complicated structure. Work rolls, furthermore, are usually changed only when there is no longer any stock to be rolled present in the roll stand, because the stock acts as an interfering edge and/or because the stock, which may in certain situations be hot, exerts thermal stress on the permanently-installed components which are required for the changing process.

A roll stand in which the stock to be rolled can pass unhindered through the stand during the change of rolls is known from JP 2006 075857 A. Before the rolls are changed, a support is raised from the drive-side chock of the lower work roll to raise the upper work roll by its chock and to suspend it from an upper mounting rail. The mounting rail extends continuously from the drive side to the operating side of the roll stand and is mounted rigidly at both ends. After the upper work roll has been suspended, the support is lowered back down again below the level of the roll stand before the removal of the work rolls begins. The upper and lower work rolls are then removed together from the roll stand, transversely to the rolling line, while the stock continues to pass through the roll stand.

SUMMARY OF THE INVENTION

The invention is based on the goal of further developing a roll stand and a method of the class in question in such a way that the space in the roll stand extending across the rolling line remains free during the rolling process—except when the rolls are being changed. In addition, it should be possible to carry out a roll change much more efficiently.

The concept of "moving" as understood in the context of the invention means not only a movement of the mounting rail as a whole, e.g., by shifting or pivoting, but also a "telescoping", that is, a movement of part of the mounting rail out of itself, e.g., in the sense of a rail which can be extended/lengthened and retracted/shortened.

The term "work roll" in the context of the invention preferably describes a roll which is in direct, effective contact with the stock during the rolling process.

The term "rolling line" describes a path along which the stock being rolled is conveyed in the rolling direction for the purpose of being rolled.

The "drive side" describes the side of the roll stand or of the work rolls on which drives are coupled to the work rolls. The "operating side" is on the side opposite the drive side and describes the side which is free of drives to allow the work rolls to be pulled out from the roll stand so that they can be changed.

When, in the present description, the terms lower and upper mounting rail, vertical shifting drive, balancing cylinder, slide part, guide rail, and support beam are used only in the singular, the statement in question refers in principle to the component of the cited device on the incoming side and also to that on the outgoing side.

The term "hold" means not fixed but rather merely restrained against the force of gravity. Movement (of the mounting rail) in the horizontal or vertical direction in particular is possible.

On the drive-side housing of the roll stand, the upper mounting rail is advantageously supported in a manner almost completely free of interfering elements. Because, on the drive-side roll stand frame, the upper mounting rail is held only by means of a guide rail, in which it is supported with freedom to shift horizontally, and because it is configured, for example, in such a way that it can be removed temporarily from the area of the rolling line by telescoping it inward toward the drive side, the space above the rolling line can advantageously be kept free of the mounting rail before and after a roll change. In addition, the upper mounting rail configured in this way does not interfere with the operating-side roll stand frame, so that the roll stand is always very conveniently accessible from the operating side.

As a result of the claimed, surprisingly simple construction of the mounting rail, the upper work roll itself can be changed even while the stock to be rolled is passing through the roll stand. An "in bar" roll change of this type is very efficient. The present device for changing work rolls can be used advantageously especially in a casting-rolling system, which works under continuous operating conditions, because there is no need to interrupt a continuous casting process to allow a roll to be changed.

Especially if the slide part provided on the chock of the upper work roll is configured appropriately, the upper mounting rail can be so short that it does not project at all or projects to only a negligible extent into the rolling line.

That the upper mounting rail can be moved out of the area of the rolling line (retracted operating state) during the rolling process—as a result of telescoping or transverse shifting or pivoting—offers the additional advantage that this mounting rail is not exposed to critical thermal stress during (hot-)rolling or is exposed to such stress to only a negligible extent. Thus, the present device can be also be used very effectively in a hot-rolling mill.

According to a first exemplary embodiment, each of the upper mounting rails comprises a slideway path, by which a slide part advantageously guides the movement of the drive-side chock of the upper work roll in an operationally reliable and low-friction manner. This is advantageous because of the operationally reliable interaction it allows between the present mounting device and the upper work roll.

It is also advantageous for the slide part to be arranged at one end of a cantilever of the drive side chock of the upper work roll, namely, at the end facing away from the chock, wherein the cantilever, which originates from the drive-side chock, preferably projects out in the direction toward the drive-side roll stand frame. As a result, the upper work roll can cooperate very effectively with the upper mounting rail.

If the cantilever is arranged so that it is parallel to the longitudinal dimension of the upper work roll, the slide part can advantageously engage transversely with the upper mounting rail.

The upper mounting rails can be shifted in an especially space-saving manner by arranging them with freedom of linear movement on the drive-side stands of the roll stand. Alternatively, however, they could be configured to move out of the rolling line by a pivoting action.

To accomplish a roll change, a drive device such as an external changing car is provided on the operating side to move the upper work roll horizontally. Once the upper work roll is connected by way of its slide part to the upper mounting rail, the upper mounting rail can also be shifted horizontally when the upper work roll is shifted. In that case the upper mounting rail does not have to have its own drive; in particular it does not have to have its own linear drive. Alternatively, however, a separate drive can be provided to shift the mounting rail or parts of it.

According to an especially advantageous variant, the upper mounting rail is telescoping. As a result, the distance by which the upper mounting rail extends across the rolling line can be varied in almost any way desired. In particular, the upper mounting rail can be very short when in the retracted state. Thus, the upper mounting rail can ideally be shifted completely out of the area of the rolling line, so that it will be well protected from the thermal effects emanating from the rolling line.

It is advantageous in particular for the upper mounting rail to telescope horizontally, so that, in an extended state, it can extend over the rolling line in cantilever fashion at least to the extent that the upper work roll can be supported at least partially by this upper support rail and shifted transversely to the rolling line in an operationally reliable manner.

Proposed according to the method is also the use of balancing cylinders, which usually serve to balance an upper support roller. The vertical shiftability of the upper mounting rail can be achieved by using the balancing cylinders which are already present in most roll stands, as vertical shifting devices. Thus, the balancing cylinder can also be used to adjust the height of the upper mounting rail and also of the upper work roll. From this arises the significant advantage that the rolls can be raised very easily by a considerable amount without the need for additional components, without interfering edges or internal rails, etc. In addition, however, it is also conceivable that a different type of vertical shifting device or drive could be used to raise the upper mounting rail.

The vertical shiftability of the upper mounting rail offers the advantageous possibility of manipulating the contact between the upper mounting rail and in particular the chock of the upper work roll. In addition, the upper work roll can be raised or lowered for a roll change by the upper mounting rail alone. As a result, it is possible for the upper mounting rail to come into effective contact with the upper work roll or its chock preferably only when a work roll change is pending. Otherwise, the upper work roll can move freely in the vertical direction during the rolling process itself.

The goal of the invention is achieved in addition by a method for removing an old roll from the roll stand and by a method for installing a new roll into the roll stand.

The term "old work roll" means a work roll which should be replaced, in particular a used-up or worn-out work roll. Conversely, the term "new work roll" means an unused work roll or work roll with a renewed circumference.

The advantages of the method correspond to the advantages pertaining to the roll stand described above.

The method according to the invention for removing an old work rolls comprises the following steps:

shifting the upper mounting rail vertically upward so that the slide parts assigned to the old upper work roll link up effectively with the upper mounting rail; and shifting the upper mounting rail vertically further upward to raise the old upper work roll suspended from the mounting rail.

Then the upper mounting rail—proceeding from the drive-side roll stand frame—is shifted along a roll-change path extending transversely to the rolling direction in cantilever fashion into the rolling line, before or while the old upper work roll—suspended on the drive side from the upper mounting rail—is moved out of the roll stand. The removal from the roll stand is typically carried out by means of an external traction device such as a roll-change locomotive. Because of the drive-side connection between the work roll and the upper mounting rails, the upper mounting rails are also shifted concomitantly into the rolling line when the work roll is pulled out.

To achieve the effective connection of the slide parts of the old upper work roll to the upper mounting rails, the upper mounting rails are raised in the vertical direction by means of a vertical shifting drive, preferably in the form of a backup roll balancing cylinder, wherein other backup roll balancing device are equally suitable.

As it is being removed from the roll stand, the old upper work roll is supported at least at the end facing the drive-side roll stand frame by the cantilevered upper mounting rail until the drive-side chock of the upper work roll can be set down onto a lower support device located on the operating-side of the rolling line, preferably onto a support arranged on the drive-side chock of the lower work roll. Only thereafter can the upper work roll be detached from the upper mounting rail.

In other words, this means that the upper mounting rails are shifted into the area of the rolling line when the work rolls on the associated roll stand are being changed. Thus, at least to some extent, the upper mounting rail moves along in the same direction as that in which the work rolls are being moved, preferably synchronously with them, transversely to the rolling line from the drive-side roll stand frame to the operating-side roll stand frame.

The method according to the invention for an installation of a new work roll comprises the following steps: effectively linking up the slide part assigned to the new upper work roll with the upper mounting rail. For installation, the farther the new upper work roll is pushed by means of an external pushing device, e.g., the roll-change locomotive, by way of the upper mounting rail toward the drive-side part of the roll stand, the farther the upper mounting rail is then shifted out of the rolling line toward the drive side as a result of, for example, a reduction in its length. After installation, the upper mounting rail is removed from the rolling line; it thus frees the space above the upper work roll for the actual rolling process.

It is advantageous that the two work rolls of the roll stand can be changed while the stock to be rolled continues to be conveyed in the rolling direction between the separated work rolls and/or while the stock is simultaneously being rolled by the work rolls of other roll stands in the rolling mill.

The freedom of the upper work roll to move vertically during the actual rolling of the stock can easily remain preserved if the upper mounting rail is shifted only in the vertical direction to bring about the contact of, and engagement between, a slide part assigned to the upper work roll and the upper mounting rail. This means that the upper mounting rail is brought into effective contact with the guide rails only for a roll change.

The upper mounting rails are arranged not only so that they can shift in the horizontal direction—at least to some extent—with respect to the rolling line but also preferably so that they can also be shifted in the vertical direction.

Thus, the upper mounting rail is not mounted in a stationary position with respect to the rolling line but rather is supported on the drive side of the rolling line by at least two axes of movement with respect to the rolling line.

Additional advantageous exemplary embodiments of the roll stand according to the invention and of the method according to the invention are the objects of the dependent claims.

It is obvious that the features of the solutions described above or in the claims can also be combined in certain cases so that the advantages can be implemented in a cumulative manner as appropriate.

Exemplary embodiments, features, effects, and advantages of the roll stand according to the invention and of the method according to the invention for changing work rolls are explained on the basis of the attached drawing and the following description.

BRIEF DESCRIPTION OF THE DRAWING

In the drawing.

In all of the figures, the same technical elements are designated by the same reference numbers.

DETAILED DESCRIPTION OF THE INVENTION

Figure 1:
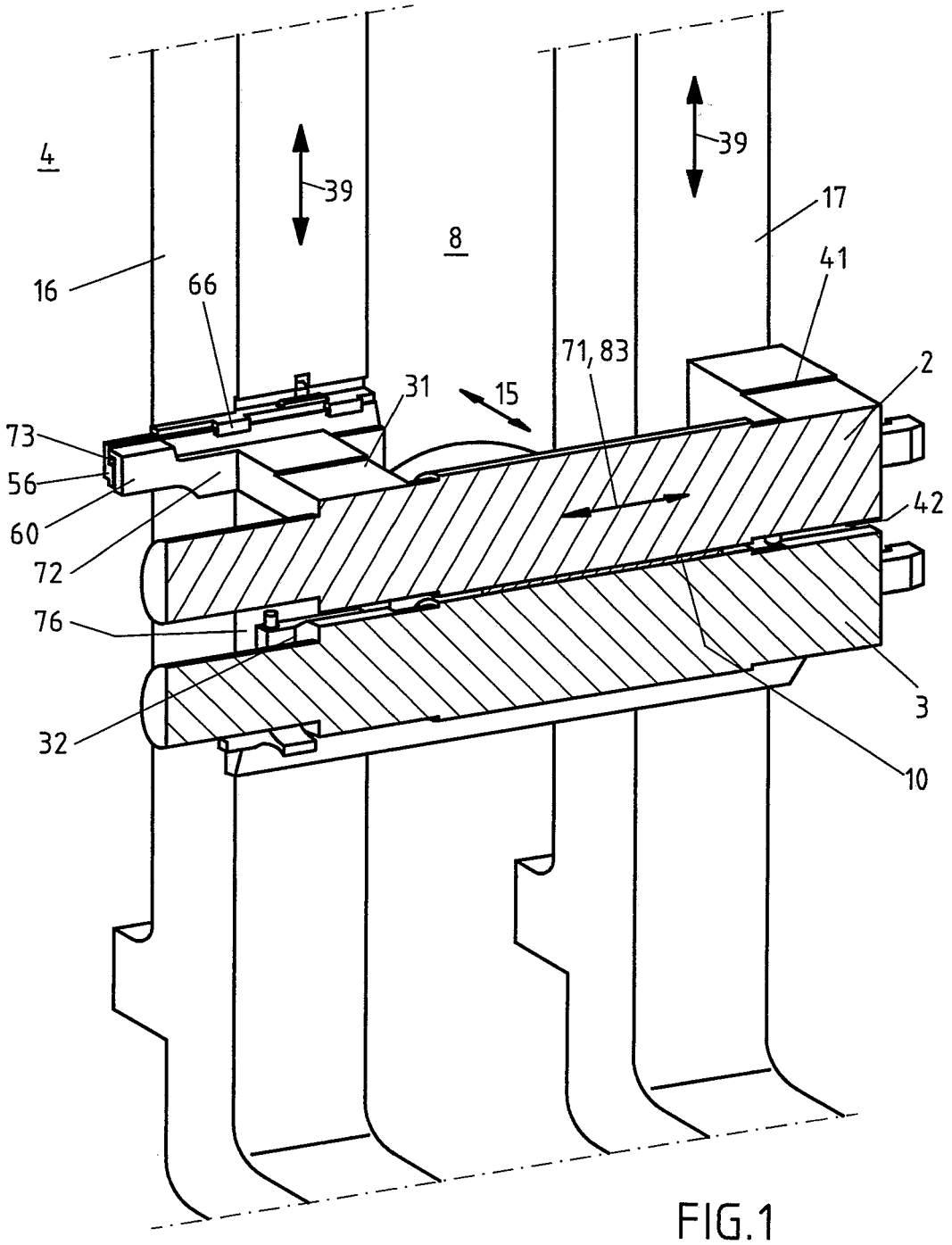
FIG. 1 shows a longitudinal cross section through a roll stand according to the invention with an upper and a lower work roll in an operating state for rolling.

FIG. 1 shows a longitudinal cross section through a roll stand 4. An upper work roll 2 and a lower work roll 3 form a roll pair extending across the rolling line 8 and creating a rolling gap, in which stock to be rolled 10 is rolled. The stock for rolling 10 is, for example, a flat metal strip.

The rolling line 8 extends in the rolling direction 15 between a drive-side roll stand frame 16 and an operating-side roll stand frame 17 of the roll stand 4. The drive-side roll stand frame 16 is characterized in that a drive unit (not shown) for rotating the work rolls 2 and 3 is arranged there.

The upper work roll 2 is rotatably supported in a drive-side chock 31 and in an operating-side chock 41. In similar fashion, the lower work roll 3 is rotatably supported in a drive-side chock 32 and in an operating-side chock 42. The chocks 31, 41, 32, 42 are also called bearing housings and are for their own part supported in the roll stand stands 16, 17 so that they can be moved in the vertical direction 39. They can also be shifted horizontally, wherein this function is not mandatory for the present invention.

The method according to the invention for the on-the-fly changing of work rolls 2, 3 held in the roll stand 4 during ongoing rolling operations is described in greater detail in the following. The roll change pertains, first, to the removal or pulling-out of the old work rolls from the roll stand 4 and, second, to the installation or pushing-in of new work rolls into the stand 4.

Figure 2:
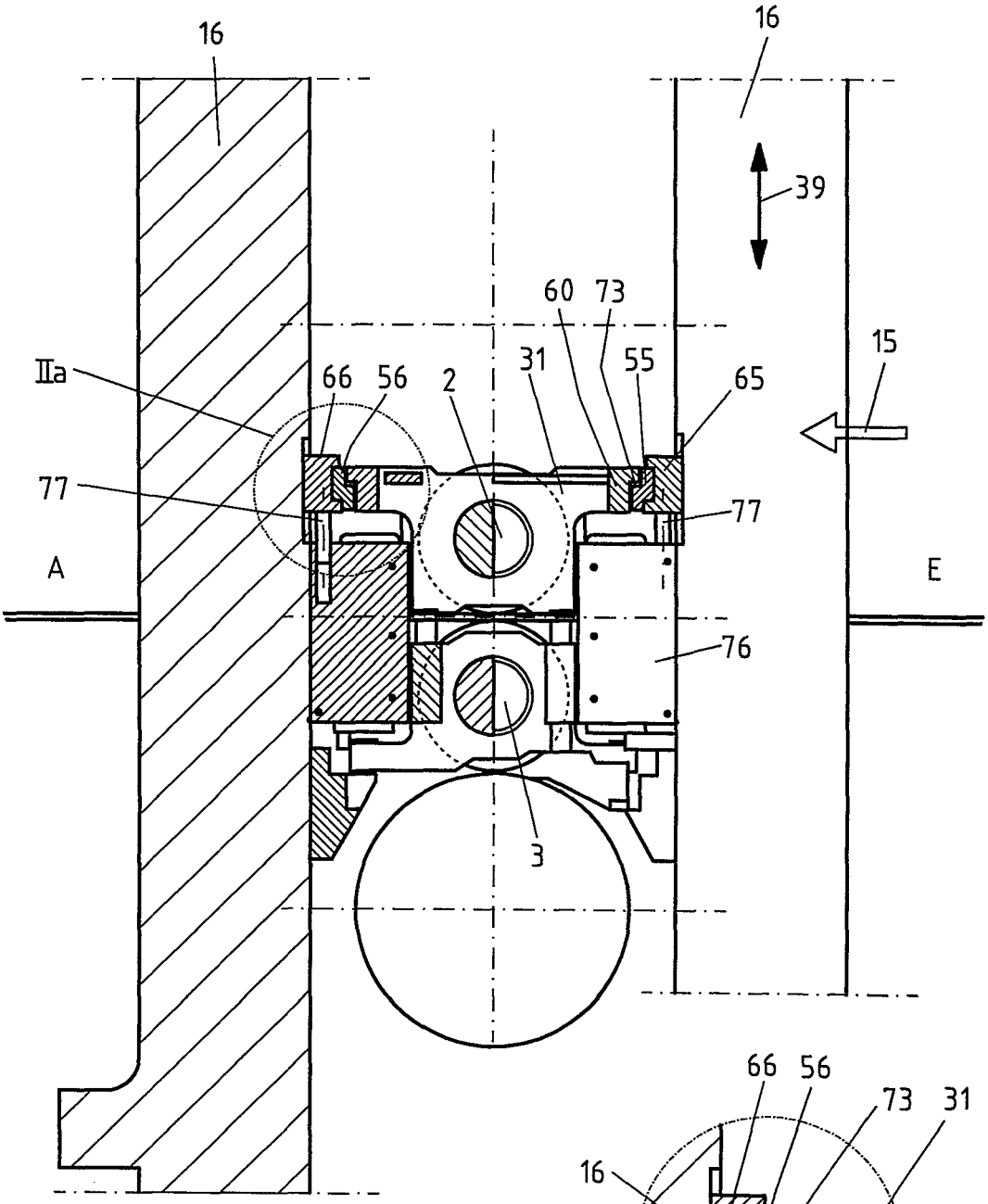
FIGS. 2 and 2*a* show cross sections through the drive-side stands of the roll stand according to the invention during the "rolling" operating state and at the beginning of an impending change of the work rolls.

The removal of the old work rolls and in particular of the old upper work roll comprises the following steps (the starting situation is shown in FIGS. 1 and 2, where the roll stand 4 and the work rolls 2 and 3 are engaged in the rolling operation):

First, the lower work roll 3 is lowered, i.e., moved downward and away from the metal strip 10, which is supported by adjacent roll stands and which preferably continues to be rolled in these other stands.

Figure 2A:
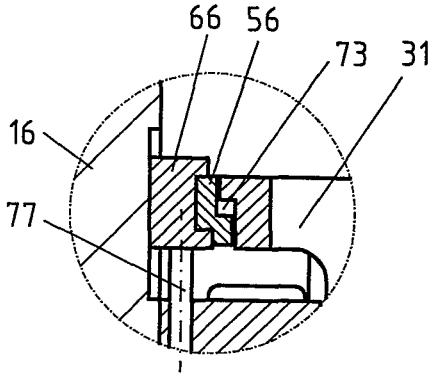

FIG. 2 shows a cross section through a drive-side roll stand frame 16, the balancing cylinders 76, and the piston parts 77 of the balancing cylinders as well as a rear view of the drive-side roll stand. The balancing cylinders 76 are permanently mounted on the roll frames and thus also on the drive-side roll frame 16. On the end facing away from the cylinder, the piston part 77 carries a guide rail 65, 66. This guide rail 65, 66 can thus be moved in the vertical direction 39 by the balancing cylinder. The guide rail 65, 66 is configured as a U-section, and an upper mounting rail 55, 56 is guided in the guide rail 65 so that it can shift or slide horizontally. The upper mounting rail 55, 56 comprises a slideway path 70. The gap 73 between the slide part 60 and the mounting rails 55, 56 can be easily seen in FIG. 2*a*.

To prepare for, i.e., at the beginning of, the roll change process, the piston part 77 of the balancing cylinder is shifted vertically upward together with the guide rail 65, 66 and the upper mounting rail 55 carried by it so that the mounting rail will link up with and support the chock 31 of the upper work roll 2 by way of the slide part 60. This situation, in which the mounting rail 55, 56, as it is moving upward, links up with the slide part 60, is shown concretely in FIG. 4. The described procedure takes place simultaneously on the incoming side E and on the outgoing side A of the drive-side roll stand frame 16. Whereas, to perform their basic function, namely, to balance the backup rolls, the balancing cylinders 76 are present on the roll stand frames 16, 17 on both the drive side and on the operating side, the special configuration according to the invention of the piston parts 77 with the guide rails 65, 66 and the upper mounting rails 55, 56 is provided only on the drive side. After the support function has been established, i.e., the link-up has occurred, the slide parts 60 are guided with freedom of horizontal movement in the slideway path 70 of the upper mounting rails in the direction of the longitudinal axes of the work rolls. The gap 73 shown in FIGS. 1, 2, and 2*a* (operating position) is closed. The slide parts 60 are permanently connected by cantilevers 72 to the drive-side chock 31 of the upper work roll 2. The cantilevers 72 are provided on the chock on both the incoming side and the outgoing side and extend preferably in the direction toward the drive-side roll stand frame. The slide parts are typically arranged in each case on the end of the cantilevers 72 facing away from the chock.

Figure 3:
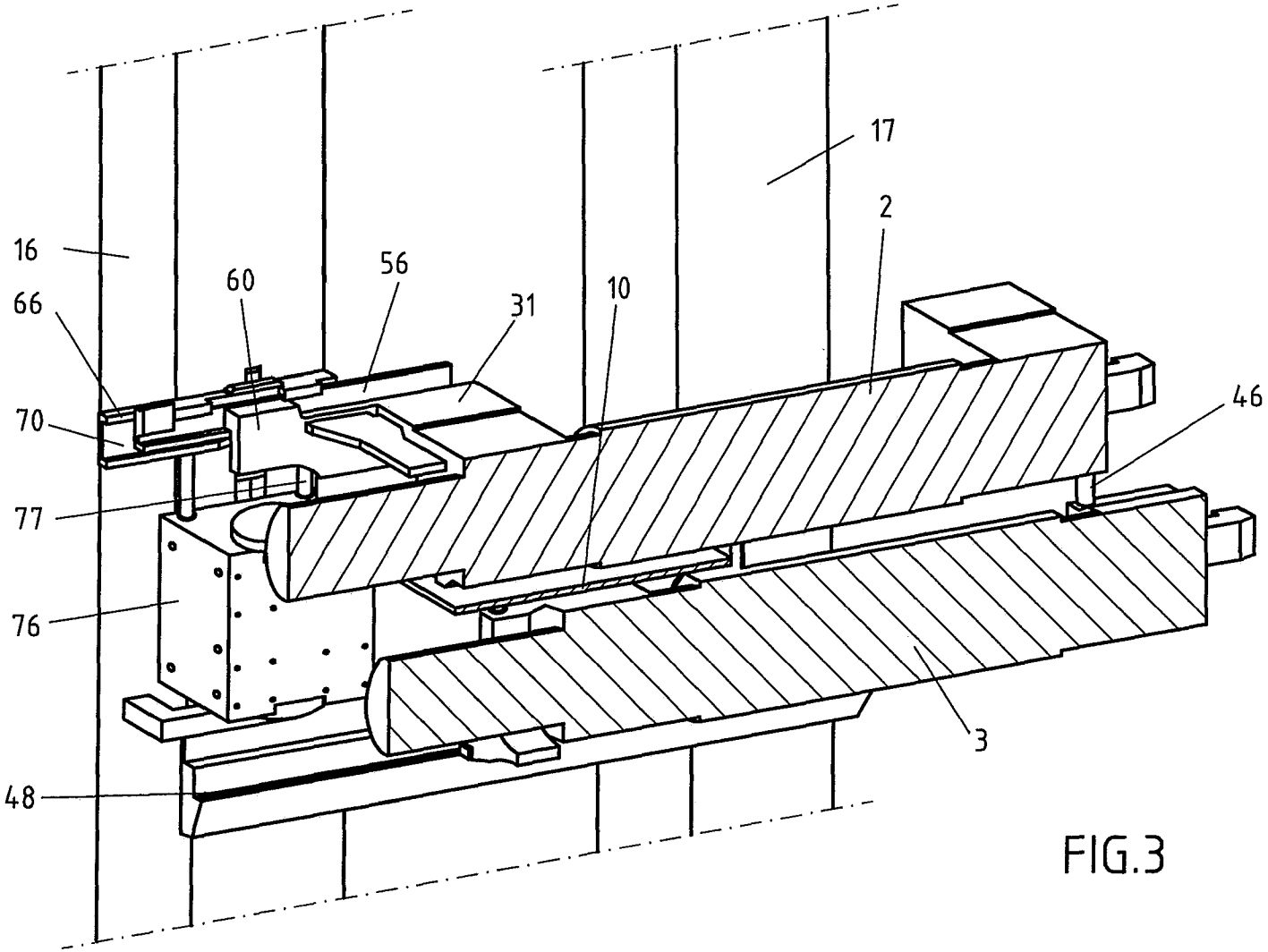
FIG. 3 shows a longitudinal cross section through the drive-side stands of the roll stand at the beginning of a roll change.

Preferably simultaneously with the above-mentioned link-up of the upper mounting rail 55 with the slide part 60 on the drive side, in preparation for the roll change on the operating side a support pin 46 is pulled out in the vertical direction 39 from the operating-side chock 42 of the lower work roll 3 and brought up against the opposing operating-side chock 41 of the upper work roll 2 from underneath; see FIG. 3.

The remaining parts of the process for removing the work rolls and 2 and 3 according to the invention are described below with reference to FIGS. 3-5:

It can be seen in FIG. 3 that the piston parts 77 of the balancing cylinders 76 and the operating-side support pin 46 have been moved further upward simultaneously, so that the upper work roll 2 has been lifted from the stock for rolling 10. In addition, the lower work roll 3 has been lowered to such an extent that it is supported by its chocks on a lower mounting rail 48; on this mounting rail 48, which is parallel to the guide rail 66 and the to the upper mounting rail 55, the lower work roll 3 is supported movably in the direction transverse to the rolling line 8. In contrast to the guide rail 66 and also in contrast to the upper mounting rail 56, the lower mounting rail 48 is configured to extend continuously from the drive side to the operating side of the roll stand on both the inlet and outgoing sides.

As previously mentioned, the lower work roll 3 is supported on the lower mounting rails 48 as shown in FIG. 3. At the same time, on the operating side the upper work roll is supported on the lower work roll by the extended support pin 46. In addition, the upper work roll 2 is supported on the drive side, as previously described, by the piston part 77 of the balancing cylinder 76 and slidingly supported on the upper mounting rail 56 by the slide part 60. In this constellation, the upper work roll 2 and the lower work roll 3 can be pulled out of the roll stand 4 by means of an external traction device such as a roll-change locomotive (not shown) transversely to the rolling direction 15. The stock 10 is not touched during this operation; on the contrary, the rolling operation can continue during the change process and in particular during the removal of the work rolls. The draft per pass of the roll stand 4, however, must be taken over by adjacent roll stands.

As can also be seen in FIG. 3, as the upper work roll 2 is being removed the upper mounting rail 56 is typically pulled out as well into the rolling line. This is typically accomplished in that, as the slide part 60 is moving out and sliding along the upper mounting rail 55, it meets a stop on the upper mounting rail, as a result of which the upper mounting rail then for its own part is shifted into the rolling line also. The upper mounting rail 56 slides along the stationary guide rail 66 in the horizontal direction.

Figure 4:
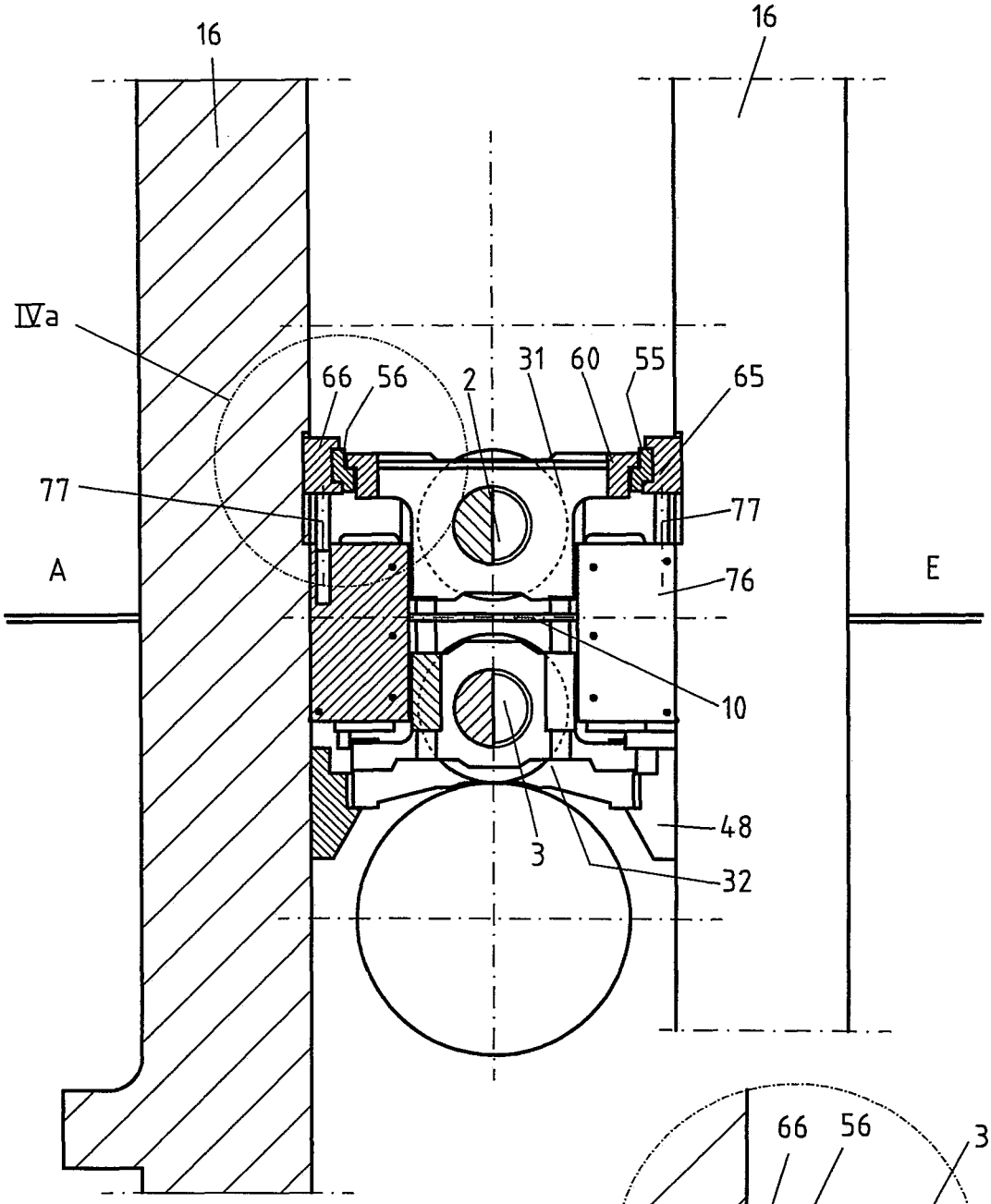
FIGS. 4 and 4*a* show cross sections through the roll stand according to FIG. 3.
Figure 4A:
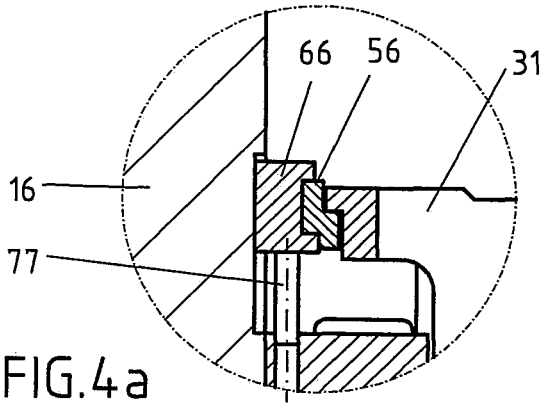

FIGS. 4 and 4*a* show cross-sectional views of the drive-side roll housing 16 in the situation just described with a closed gap 73.

Figure 5:
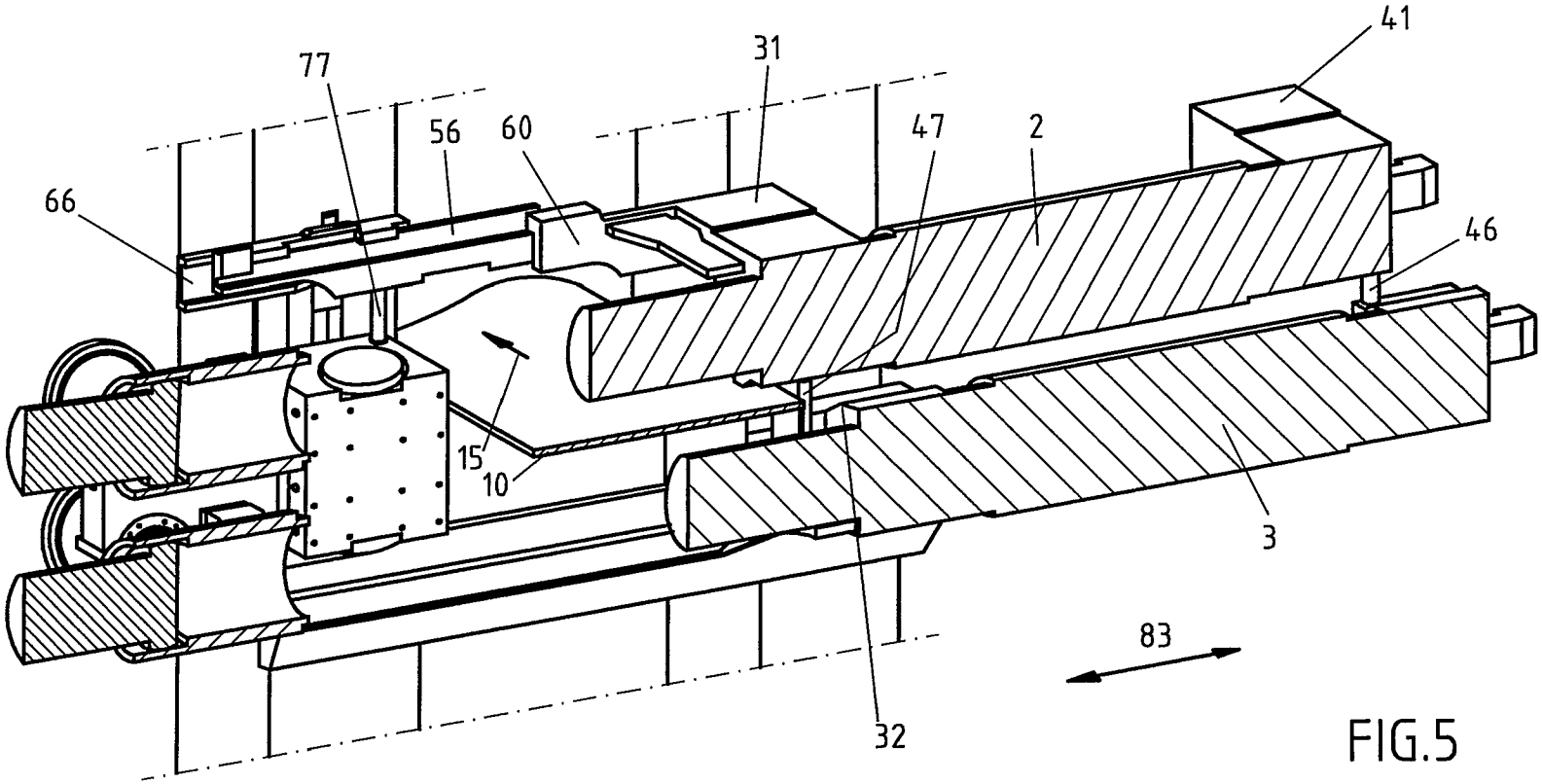
FIG. 5 shows a longitudinal cross section through the roll stand after the work rolls have been almost completely removed during a roll change.

FIG. 5 shows the end of the process of removing the work rolls 2 and 3. The work rolls 2 and 3 have now been moved out of the roll stand in the removal direction transverse to the rolling direction 15 to such an extent that their drive-side chocks 31, 32 have passed by the stock for rolling 10. Up to this point, the upper work roll is suspended on the drive side only from the upper mounting rails 55, 56, which have been moved out and into the rolling line 8, and thus hangs over the stock 10.

After the chocks 31, 32 have passed by the stock 10, drive-side support pins 47, preferably on the incoming side and the outgoing side of the roll stand, move up and out of the lower drive-side chock 32 of the lower work roll 3 until they contact the bottom of the opposing, drive-side chock 31 of the upper work roll 2, as shown in FIG. 5. The drive-side support pins 47 then accept the partial load of the upper work roll which has been carried until now by the upper mounting rail 55 and support it from underneath. The connection between the slide part 60 and the upper mounting rail 55 can therefore now be released. The lower work roll 3 and the upper work roll 2 now form a compact unit, in which the upper work roll 2 rests on the lower work roll 3; this compact unit can then be pulled completely out of the roll stand 4 by means of the traction device.

The second part of the roll change, i.e., the installation of the new work rolls, proceeds basically by the reverse sequence of steps and in the direction of movement of the work rolls and mounting rails which is the reverse of that used during the removal of the work rolls just described. In particular, the farther the new upper work roll is shifted toward the drive side, the farther the upper mounting rails 55, 56—after the slide parts 60 of the drive-side chock 31 of the new upper work roll have become supported on them—are shifted out of the rolling line toward the drive side. As the new upper work roll is being moved into position, its slide part 60, as it slides along the upper mounting rails 55, 56, will again meet a stop, which has the effect of pushing the upper mounting rail 55, 56 back again out of the rolling line. Once the new upper work roll is held by its drive-side chock on the drive-side housing of the roll stand, the balancing cylinder piston parts 77 and, together with them, the guide rails 65, 66 and the upper mounting rails 55 slidingly supported in them, are according to the invention lowered again, as a result of which the contact between the slide parts 60 and the upper mounting rails 55, 56 is lost and the gap 73 is formed.

The present invention thus provides for a repurposing of a component which is present in any case in the roll stand, namely, the balancing cylinder 76; that is, this cylinder is now used in particular to shift a guide rail 55 vertically, in particular to shift it together with an upper mounting rail 55 which is guided in it and which carries the upper work roll 2.

LIST OF REFERENCE NUMBERS

2 upper work roll
3 lower work roll
4 roll stand
8 rolling line
10 stock for rolling
15 rolling direction
16 drive-side roll stand frame
17 operating-side roll stand frame
31 upper drive-side chock
32 lower drive-side chock
39 vertical direction
41 upper operating-side chock
42 lower operating-side chock
46 operating-side support pin
47 drive-side, height-adjustable support pin
48 lower mounting rail
55 upper mounting rail, incoming side
56 upper mounting rail, outgoing side
60 slide parts
65 inlet-side guide rails
66 outlet-side guide rails
70 slideway path
71 longitudinal dimension
72 cantilever
73 gap
76 balancing cylinder

77 balancing piston part
83 change path
E incoming side
A outgoing side

The invention claimed is:

1. A roll stand, comprising:

a drive-side roll stand frame;

an operating-side roll stand frame, wherein the drive-side roll stand frame and the operating-side roll stand frame are separated from each other by a rolling line passing through the roll stand;

an upper, horizontally oriented work roll and a lower, horizontally oriented work roll rotatably supported in chocks on both of the roll stand frames so that the upper, horizontally oriented work roll and the lower, horizontally oriented work roll extend from the operating-side roll stand frame to the drive-side roll stand frame; and upper mounting rails held only on the drive-side roll stand frame, the upper mounting rails including an upper mounting rail on an incoming side and a further upper mounting rail on an outgoing side to support the upper, horizontally oriented work roll during a roll change, wherein the upper mounting rails extend transversely to the rolling line, wherein the upper mounting rails are horizontally displaceable between a retracted operating state, in which the upper mounting rails do not project into the rolling line, and an extended operating state, in which the upper mounting rails, starting from the drive-side roll stand frame, project into the rolling line at least up to a longitudinal center line of the rolling line, wherein only the drive-side roll stand frame has the displaceable upper mounting rails.

2. The roll stand according to claim 1, wherein the upper mounting rails each comprise a slideway path, in which a drive-side chock of the upper work roll is slidably guided by slide parts on the incoming side and the outgoing side.

3. The roll stand according to claim 2, wherein the slide parts are arranged on ends of cantilevers of the drive-side chock of the upper work roll, wherein the cantilevers, starting from the drive-side chock, extend freely outward.

4. The roll stand according to claim 3, wherein the cantilevers extend in a direction toward the drive-side roll stand frame.

5. The roll stand according to claim 1, wherein the upper mounting rails are configured to be horizontally telescopable.

6. The roll stand according to claim 1, further comprising guide rails held in stationary fashion in a horizontal direction, the mounting rails being movably supported in the guide rails in the horizontal direction.

7. The roll stand according to claim 6, further comprising vertical shifting drives for raising and lowering the guide rails, the vertical shifting drives being supported on the drive-side roll stand frame.

8. The roll stand according to claim 7, wherein the vertical shifting drives are configured as balancing cylinders for balancing an upper backup roll; and the guide rails are arranged on free ends of the balancing cylinders not supported on the roll stand.

9. A method for changing horizontally oriented work rolls held in a roll stand during ongoing rolling operations, wherein the roll stand comprises a drive-side roll stand frame and an operating-side roll stand frame, and wherein vertically movable guide rails with upper mounting rails are held only on the drive-side roll stand frame, the upper mounting rails including an upper mounting rail on an incoming side and a further upper mounting rail on an outgoing side, wherein the upper mounting rails are horizontally displaceable between a retracted operating state, in which the upper mounting rails do not project into a rolling line, and an extended operating state, in which the upper mounting rails, starting from the drive-side roll stand frame, project into the rolling line at least up to a longitudinal center line of the rolling line, wherein only the drive-side roll stand frame has the displaceable upper mounting rails, the method for changing the work rolls comprising the steps of:

vertically moving the guide rails together with the upper mounting rails upward to link up the upper mounting rails with slide parts assigned to an old upper, horizontally oriented work roll; and vertically moving the guide rails together with the upper mounting rails even more to lift the old upper, horizontally oriented work roll suspended from the upper mounting rails, wherein the upper mounting rails, starting from the drive-side roll stand frame, are horizontally displaced along a change path extending transversely to a rolling direction in a cantilever fashion into the rolling line, while the old upper, horizontally oriented work roll, suspended from the upper mounting rail, is moved out of the roll stand.

10. The method according to claim 9, including supporting the roll stand, the old upper work roll of a roll pair during removal from the roll stand at an end facing the drive-side roll stand frame by the shifted or outwardly-moved upper mounting rail until a drive-side chock of the old upper work roll is set down onto a lower support device located on the operating-side of the rolling line so that the old upper work roll is detachable from the upper mounting rail.

11. The method according to claim 10, including setting the drive-side chock onto at least one support pin that is extendable from a drive-side chock of a lower work roll.

12. The method according to claim 9, including using a support roller balancing cylinder supported on the drive-side roll stand frame of the roll stand for vertically displacing one of the plurality of guide rails together with the upper mounting rail and which is used to support the upper work roll.

13. A method for changing horizontally oriented work rolls held in a roll stand during ongoing rolling operations, wherein the roll stand comprises a drive-side roll stand frame and an operating-side roll stand frame, and wherein vertically movable guide rails with upper mounting rails are held only on the drive-side roll stand frame, the upper mounting rails including an upper mounting rail on an incoming side and a further upper mounting rail on an outgoing side, wherein the upper mounting rails are horizontally displaceable between a retracted operating state, in which the upper mounting rails do not project into a rolling line, and an extended operating state, in which the upper mounting rails, starting from the drive-side roll stand frame, project into the rolling line at least up to a longitudinal center line of the rolling line, wherein only the drive-side roll stand frame has the displaceable upper mounting rails, wherein the method for changing work rolls comprises the steps of:

removing an existing upper, horizontally oriented work roll from the roll stand;

linking up the upper mounting rails with slide parts assigned to a drive-side chock of a new upper, horizontally oriented work roll so that as the new upper, horizontally oriented work roll is horizontally displaced further by way of the upper mounting rails in a direction toward a drive-side part of the roll stand the upper mounting rails are horizontally displaced further out of the rolling line in a direction toward the drive side.

14. The method according to claim 13, including lowering the guide rails together with the upper mounting rails, once the new upper work roll is held by the drive-side chock in the drive-side roll stand frame, to eliminate contact between the slide parts of an upper chock and the upper mounting rails.

15. The method according to claim 13, including using a support roller balancing cylinder supported on the drive-side roll stand frame of the roll stand for vertically displacing one of the plurality of guide rails together with the upper mounting rail and which is used to support the upper work roll.

* * * * *